US010692328B2

(12) United States Patent
Berman

(10) Patent No.: US 10,692,328 B2
(45) Date of Patent: Jun. 23, 2020

(54) GAMING DEVICES WITH BONUS MECHANIC SELECTION

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 46 days.

(21) Appl. No.: 15/807,212

(22) Filed: Nov. 8, 2017

(65) Prior Publication Data

US 2018/0130309 A1 May 10, 2018

Related U.S. Application Data

(60) Provisional application No. 62/419,439, filed on Nov. 8, 2016.

(51) Int. Cl.

| | |
|---|---|
| ***G07F 17/00*** | (2006.01) |
| ***G07F 19/00*** | (2006.01) |
| ***G07F 17/32*** | (2006.01) |
| ***G07F 17/34*** | (2006.01) |

(52) U.S. Cl.

CPC ..... *G07F 17/3267* (2013.01); *G07F 17/3213* (2013.01); *G07F 17/3244* (2013.01); *G07F 17/34* (2013.01)

(58) Field of Classification Search

CPC ..... G07F 17/3211; G07F 17/3213; G07F 17/3216; G07F 17/3244; G07F 17/3267; G07F 17/34

See application file for complete search history.

(56) References Cited

U.S. PATENT DOCUMENTS

| | | | | |
|---|---|---|---|---|
| 6,695,696 | B1 * | 2/2004 | Kaminkow | G07F 17/3211 273/138.2 |
| 2002/0142846 | A1 * | 10/2002 | Paulsen | G06Q 30/0209 463/43 |
| 2005/0054419 | A1 * | 3/2005 | Souza | G07F 17/32 463/20 |
| 2009/0131145 | A1 * | 5/2009 | Aoki | G07F 17/3211 463/20 |
| 2009/0275382 | A1 * | 11/2009 | Vallejo | G07F 17/3209 463/20 |
| 2010/0016055 | A1 * | 1/2010 | Englman | G07F 17/3244 463/20 |
| 2010/0048293 | A1 * | 2/2010 | Hornik | G07F 17/3244 463/25 |
| 2017/0092045 | A1 * | 3/2017 | Kitamura | G07F 17/3209 |

* cited by examiner

*Primary Examiner* — Milap Shah

(57) ABSTRACT

Embodiments of the present invention set forth systems, apparatuses and methods for implementing a selection mechanic for bonuses or features available on the gaming device. Accordingly, a gaming device can be configured to have a set of mechanical reels for play of a primary game, and a video display configured to show virtual reels in a video slot presentation. When a bonus, such as a free spins or free games bonus, is triggered, the gaming device may provide the player an option to play the bonus on either the mechanical game reels or the video game reels. Each option may have different characteristics, which may be communicated to the player to aid in their selection of the display to implement the bonus event.

20 Claims, 8 Drawing Sheets

GAMING DEVICES WITH BONUS MECHANIC SELECTION

RELATED APPLICATIONS

This application claims the benefit of Provisional Patent Application No. 62/419,439, filed on Nov. 8, 2016, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for implementing a bonus mechanic selection in gaming devices.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate implementing a bonus mechanic selection. In one embodiment, a gaming device includes a first game display including a first game grid showing portions of a plurality of mechanical game reels each having a plurality of symbols on respective reelstrips, and a second game display including a video display configured to display a second game grid showing portions of a plurality of virtual game reels each having a plurality of symbols on respective virtual reelstrips. The gaming device may also include a processor operable to initiate a primary gaming event to be played on the first game display in response to a received wager, and determine a game outcome for the primary gaming event. The processor may further be operable to initiate a bonus event based on a condition being satisfied in the primary gaming event. The bonus event may include providing a selectable option to play the bonus event on the first game display or the second game display, where a selection to play the bonus event on the first game display will use a first set of bonus instructions to operate the bonus event, and where a selection to play the bonus even on the second game display will use a second set of bonus instructions to operate the bonus event. In some embodiments, the bonus event may include sets of free spins using either the mechanical game reels in the first game display or the virtual game reels in the second game display. In some embodiments, aspects of the first set of instructions to play the bonus event on the first game display and aspects of the second set of instructions to play the bonus event on the second game display are communicated to the player to provide attributes of each selection. These attributes may differ in the type of bonus offered, the number of free spins offered, the number of paylines in play, the volatility of each option, the use of multipliers, symbol stacks or other modifiers, and/or other aspects of each option.

DETAILED DESCRIPTION

Figure 1:
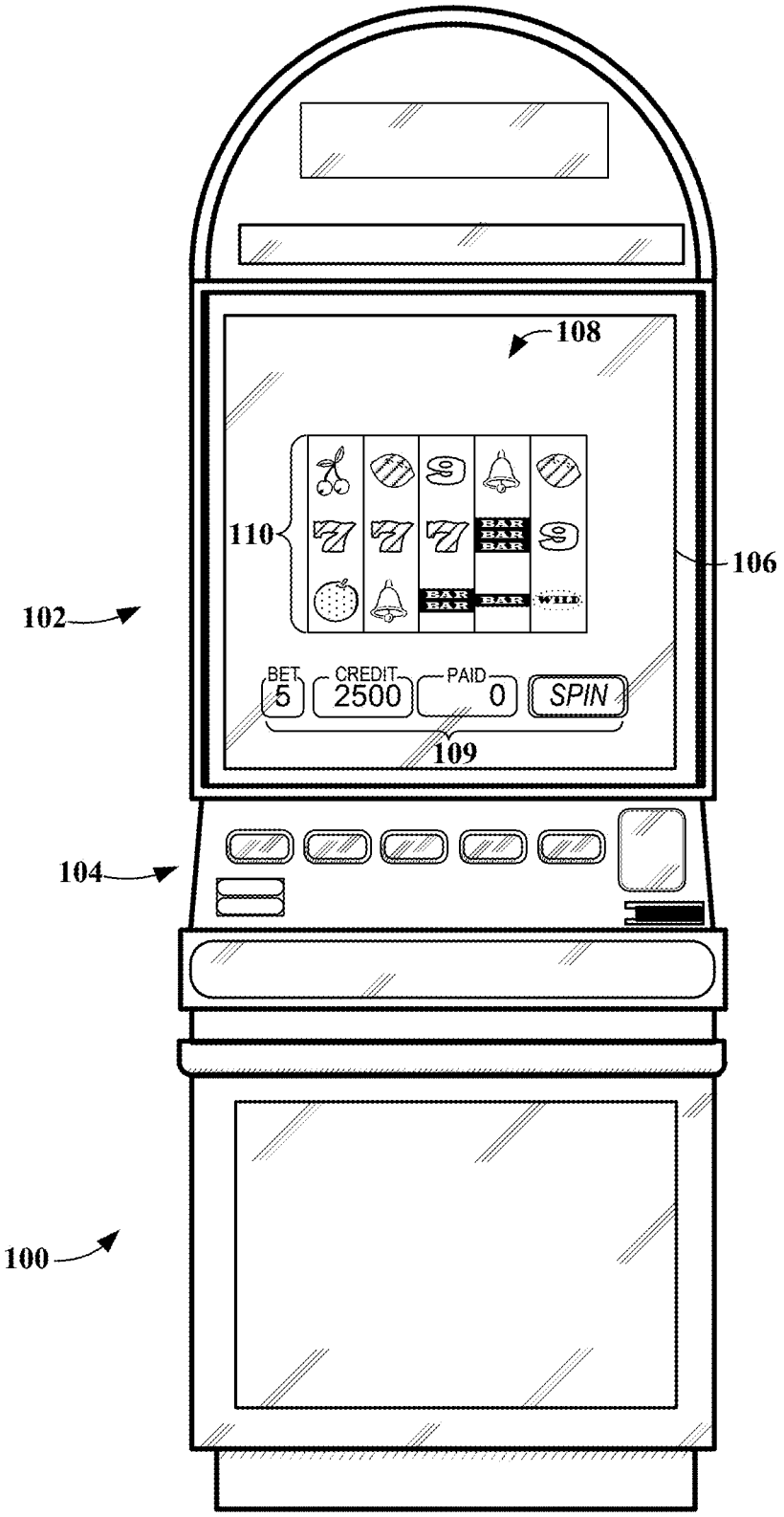
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for implementing a bonus mechanic selection in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that utilizes operations of implementing a bonus mechanic selection. In one embodiment, a method of operating a gaming device includes providing a first game display with a plurality of mechanical reels with a first game grid, and a second game display with a video representation of a plurality of game reels in a second game grid. Here, a base game may be played in one of the first game display or second game display. However, when a free spins or free game bonus is triggered, the player may be given the option to play the free spins or free games on the current game display associated with the primary or base game, or may select to play at least a portion of the free spins or free games on the other game display not associated with the primary or base game.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player loyalty information to identify a user or player of the gaming device. This mechanism may be card reader, biometric scanner, keypad, or other input device. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

Figure 2:
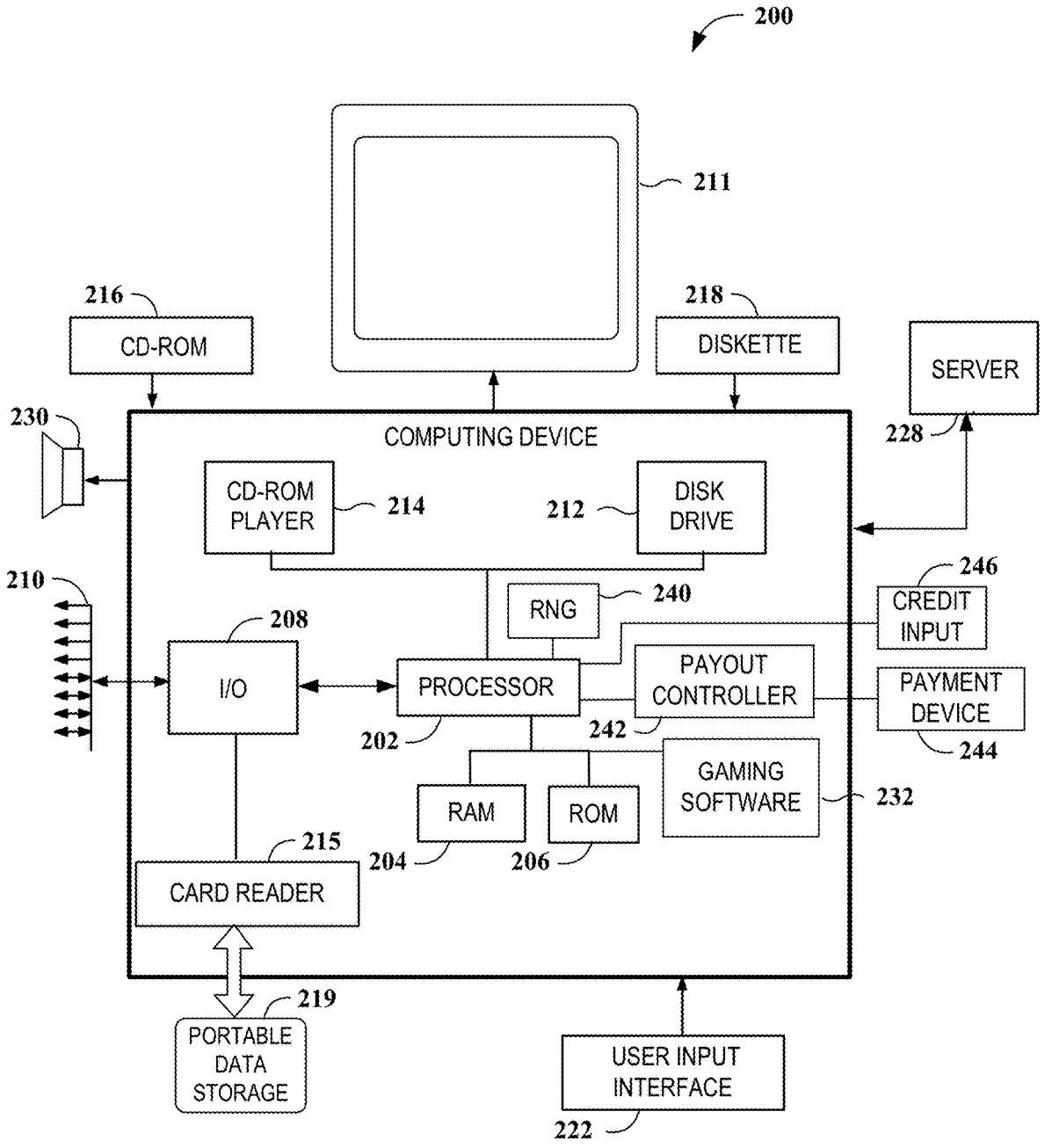
FIG. 2 is a block diagram illustrating a computing arrangement according to embodiments of the invention.

Although FIG. 1 illustrates a particular implementation of some of the embodiments of this invention in a casino or electronic gaming machine ("EGM"), one or more devices may be programmed to play various embodiments of the invention. The present invention may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the invention is illustrated in FIG. 2.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 200 of FIG. 2 is an example computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions in accordance with the present invention typically includes a central processor (CPU) 202 coupled to random access memory (RAM) 204 and some variation of read-only memory (ROM) 206. The ROM 206 may also represent other types of storage media to store programs, such as programmable ROM (PROM), erasable PROM (EPROM), etc. The processor 202 may communicate with other internal and external components through input/output (I/O) circuitry 208 and bussing 210, to provide control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to the display 211, which represents a display on which the gaming activities in accordance with the invention are presented. The display 211 represents the "presentation" of the game information in accordance with the invention, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, or inputting data to identify a player for a player loyalty system. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs may be implemented using hardware, software operable in connection with the processor 202, or some combination of hardware and software. The present invention is operable using any known RNG, and may be integrally programmed as part of the processor 202 operation, or alternatively may be a separate RNG controller 240. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout device 244 may also be provided in gaming machine embodiments, where the payout device 244 serves as the mechanism providing the payout to the player or participant. In some embodiments, the payout device may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payout device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described hereinabove. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 232 may include instructions to provide other functionality as known in the art or as described and shown herein.

As discussed above, embodiments of the present concept include providing gaming devices, gaming systems, and methods of operating these devices or systems to provide game play that utilizes operations of implementing a bonus mechanic selection. In one embodiment, a method of operating a gaming device includes providing a first game display with a plurality of mechanical reels with a first game grid, and a second game display with a video representation of a plurality of game reels in a second game grid. Here, a base game may be played in one of the first game display or second game display. However, when a free spins or free game bonus is triggered, the player may be given the option to play the free spins or free games on the current game display associated with the primary or base game, or may select to play at least a portion of the free spins or free games on the other game display not associated with the primary or base game.

In some embodiments, a gaming device includes a first game display including a first game grid showing portions of a plurality of mechanical game reels each having a plurality of symbols on respective reelstrips, and a second game display including a video display configured to display a second game grid showing portions of a plurality of virtual game reels each having a plurality of symbols on respective virtual reelstrips. The gaming device may also include a processor operable to initiate a primary gaming event to be played on the first game display in response to a received wager, and determine a game outcome for the primary gaming event. The processor may further be operable to initiate a bonus event based on a condition being satisfied in the primary gaming event. The bonus event may include providing a selectable option to play the bonus event on the first game display or the second game display, where a selection to play the bonus event on the first game display will use a first set of bonus instructions to operate the bonus event, and where a selection to play the bonus even on the second game display will use a second set of bonus instructions to operate the bonus event. In some embodiments, the bonus event may include sets of free spins using either the mechanical game reels in the first game display or the virtual game reels in the second game display. In some embodiments, aspects of the first set of instructions to play the bonus event on the first game display and aspects of the second set of instructions to play the bonus event on the second game display are communicated to the player to provide attributes of each selection. These attributes may differ in the type of bonus offered, the number of free spins offered, the number of paylines in play, the volatility of each option, the use of multipliers, symbol stacks or other modifiers, and/or other aspects of each option.

In various embodiments, the free games may have very different characteristics between the one implemented on the first game display with the mechanical reels, and the one implemented on the second game display with the video reels. These different characteristics may include different volatilities, different numbers of spins, different paylines, different paytables, different retrigger features, different game features, different payer interaction, etc. These differences may be communicated to the player in some embodiments, but not communicated or not completely communicated to the player in other embodiments.

Figure 3:
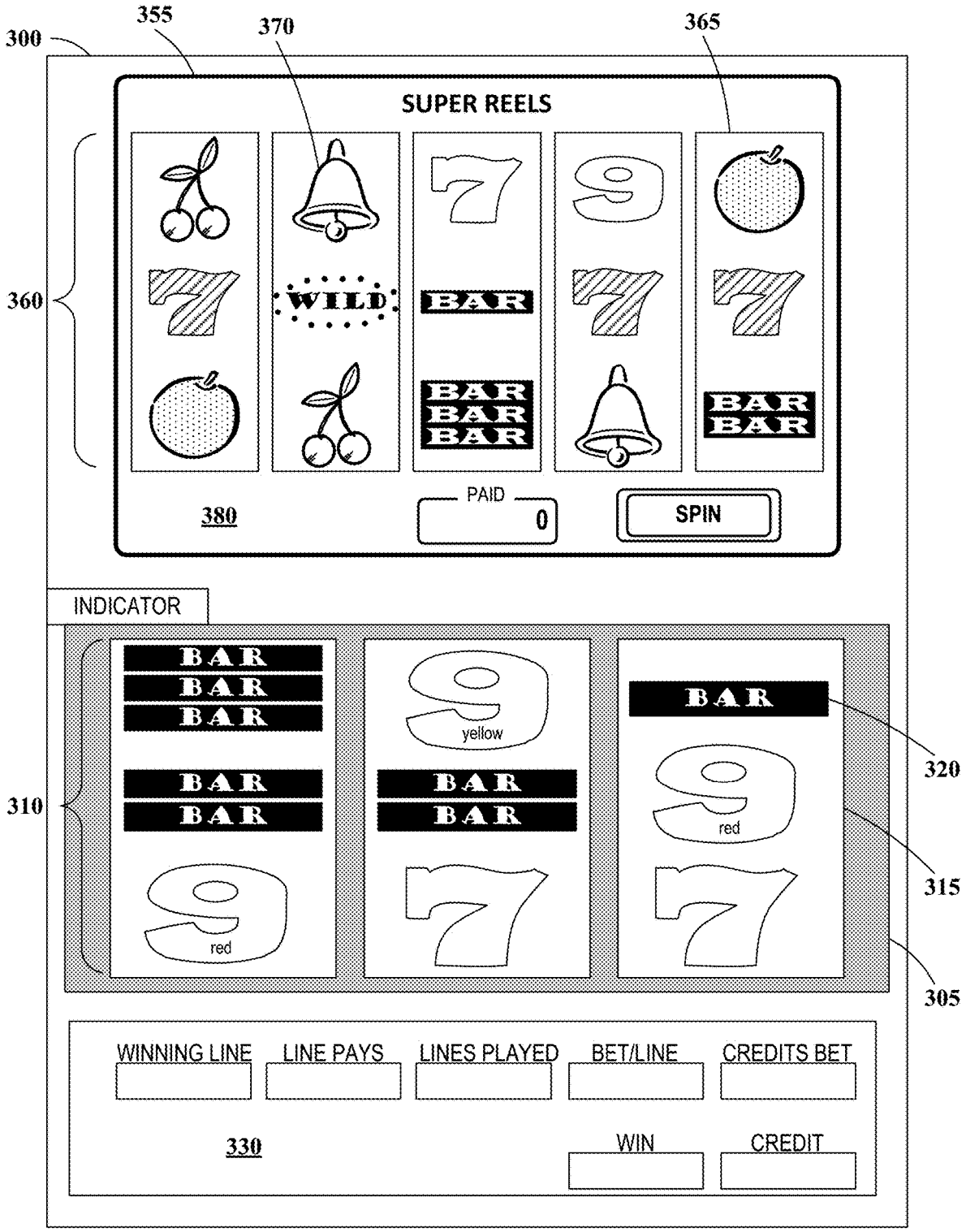
FIG. 3 is a detail diagram of a gaming device having a first gaming display and a second gaming display according to embodiments of the invention.

FIG. 3 is a detail diagram of a gaming device 300 having a first gaming display 305 and a second gaming display 355 according to embodiments of the invention. Referring to FIG. 3, the first gaming display 305 includes a plurality of mechanical game reels 315 that each include multiple game symbols 320. The game symbols 320 may be printed or otherwise fixed to physical reel strips on the mechanical game reels 315. Stepper motors or other devices capable of moving the game reels may be used to spin and stop the mechanical game reels. In some embodiments, lighting or other effects may be used to alter the appearance of the fixed game symbols 320 on the mechanical game reels 315. In other embodiments, a transmissive screen may be used over the mechanical game reels 315 to allow touch screen properties, show transmissive symbols overlaying the mechanical game reels, or allow other dynamic presentations during game events. The first display includes a first game grid 310 that allows for a portion of the symbols 320 to be visible during reel spins and when the reels stop. The first game grid 310 may include glass with translucent windows to show the game reel 315 portions and include printed or otherwise opaque sections. The gaming device may also include an input area 330 where buttons, meters, bill acceptors, ticket printers, and other input or output devices for interacting with the gaming device are located.

The second gaming display 355 may include a video display, such as an LCD, LED, CRT, or other screen, that is configured to show a variety of images, artwork, attract screens, and secondary games. As shown in FIG. 3, the second gaming display can be configured to show a video slot game including a second game grid 360 showing portions of virtual game reels 365 each having a plurality of game symbols 370. The video display 355 may also have an interface area 380 that shows messaging, meters, etc., as well as "soft" input devices such as a touch screen buttons, etc.

In FIG. 3, the gaming device is shown having a mechanical primary game in the first game display 305 and a secondary video display 355 used to display a video slot game, which may only be available as part of a bonus selection mechanic as described below. However, in other embodiments both the first and the second game displays may have mechanical spinning reels, both the first and the second game displays may have video displays showing video slots games, the first game display may show a video poker (or other type of game of chance) while the second game display shows a video slot game or a different video game of chance, the first game display could have a video display to show video slot game while the second game display may have mechanical reels, as well as other combination of displays being possible. As discussed below, a primary game may be played on the first game display 305 and an option to play a bonus game on either the first game display or the second game display 355 may be presented when a bonus trigger is satisfied during play of the primary game. Thus, depending on the set up of the gaming device, multiplier different styles of games may be available as part of a bonus function. The different displays allow for the player to continue playing a similar style game in the bonus, or something different. Hence, in some embodiments, it may be advantageous to have different characteristics between the games available in the first game display 305 and second game display 355.

In yet other embodiments, a player may be able to switch games in the first game display 305 and second game display 355 to vary the play of the game. This may be difficult if one of the displays is configured to have mechanical reels, but may be possible using transmissive style glass over the mechanical game reels, or other techniques of having virtual or different symbols overlaying or modifying the fixed symbols 320 on the physical reel strips 315. In still other embodiments, a player may be able to play game events on both the first game display 305 and the second game display 355 simultaneously as parts of primary game events.

Additionally, the second game display 355 (and/or first game display 305) may also for a completely different type of second screen bonus, such as a pick bonus, quest bonus, skill-based bonus, or other types of bonus features that do not necessarily correlate to typical games of chance. In some embodiments, the first game display 305 and second game display 355 may be on physically separate displays, while in other embodiments, the first game display and the second game display may be portions of the same physical display device (such as a large video display screen).

Figure 4:
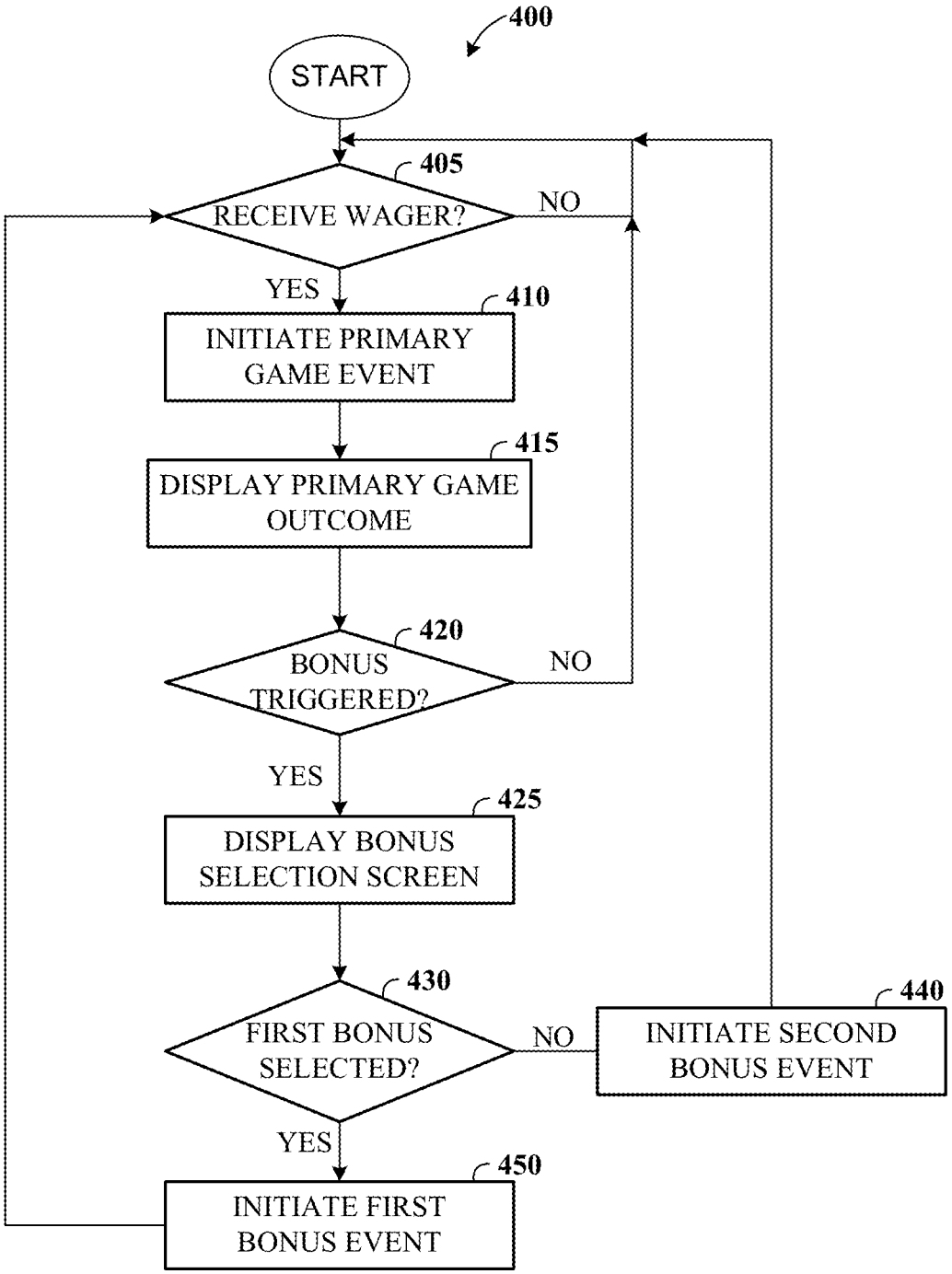
FIG. 4 is a flow diagram illustrating a method of operating a gaming device according to embodiments of the invention.

FIG. 4 is a flow diagram representing methods in which a gaming device and/or gaming system can be operated according to embodiments of the invention. Although various processes are shown in a particular order in this flow diagram, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that these example methods are just some embodiments of how the steps of a game operation can be implemented. As discussed and shown above, many variations exist which may require additional, fewer, or different processes to complete.

Referring to FIG. 4, the flow 400 begins at process 405 where the gaming device checks to see if a wager has been received. Once a wager has been received on a game event in process 405, flow 400 progresses to process 410 where the gaming device initiates a primary or base game event. Here, the received wager may be deducted from a credit amount stored in a memory of the gaming device. After a gaming outcome is randomly determined by a processor in the gaming device, the primary game outcome is displayed on a gaming display as part of process 415. Here, the primary gaming event may be displayed on a first game display of the gaming device. In process 420, it is determined whether a bonus trigger condition is present to trigger a bonus feature.

In some embodiments, the presence of a predefined symbol combination or symbol (such as a wild symbol, bonus symbol, jackpot symbol, progressive symbol, etc.) in the game outcome satisfies the feature trigger condition. In other embodiments, the trigger condition may be based at least in part on receipt of a side wager, a sub-symbol, a symbol overlay, a random determination, a player's loyalty status, prior game results, a result of another game feature or bonus, etc. and/or a combination of the above. If the bonus trigger condition is not satisfied in process 420, flow 400 returns to process 405 to await another wager or other player action. If the bonus trigger condition is satisfied in process 420, flow 400 proceeds to process 425 where a bonus selection screen is displayed. Here, the bonus selection screen may allow a player to select to play a bonus on the first game display or to play a different style bonus game on a second game display. For example, a first game display may include mechanical spinning reels and the second game display may include a video display with a video slot game. If the bonus is a free spins or free games bonus, the player may be able to play the free games on the same mechanical reels as the primary game is played on, or play the free games on the video display with the video slot game. Here, the video slot game may provide additional features, such as differing numbers of game reels, paylines, game grid sizes, symbol stacks, multiplier symbols, etc. Additionally, the characteristics of the bonus itself may be different between the two (or more) offered bonus choices. For example, the player may only get 5 free spins on the mechanical game reels, but may get 10 free spins on the video reels. In another example, a player may be playing a video poker game in the first game display, but be offered a bonus of playing 10 free spins of a video slot game in the second game display when the bonus is triggered, or, for example, get a multiplier for the next poker hand on the first game display.

In process 430, it is determined if the first bonus option is selected (or which of the multiple bonus options are selected if there are two or more options). If it is indicated that the second bonus event is selected in process 430, flow 400 proceeds to process 440 to initiate and play the second bonus event on the second game display. Flow 400 would then return to process 405 to await another game wager. On the other hand, if it is indicated that the first bonus event is selected in process 430, flow 400 proceeds to process 450 to initiate and play the first bonus event on the first game display. Flow 400 would then also return to process 405 to await another game wager.

FIGS. 5A, 5B, 5C and 5D are detail diagrams of a gaming device 500 having a first gaming display 505 and a second gaming display 555 showing an example game progression according to embodiments of the invention. Referring to FIGS. 5A-5D, the first gaming display 505 includes a plurality of mechanical game reels 515 that each include multiple game symbols 520. The game symbols 520 may be printed or otherwise fixed to physical reel strips on the mechanical game reels 515. Stepper motors or other devices capable of moving the game reels may be used to spin and stop the mechanical game reels. In some embodiments, lighting or other effects may be used to alter the appearance of the fixed game symbols 520 on the mechanical game reels 515. In other embodiments, a transmissive screen may be used over the mechanical game reels 515 to allow touch screen properties, show transmissive symbols overlaying the mechanical game reels, or allow other dynamic presentations during game events. The first display includes a first game grid 510 that allows for a portion of the symbols 520 to be visible during reel spins and when the reels stop. The first game grid 510 may include glass with translucent windows to show the game reel 515 portions and include printed or otherwise opaque sections. The gaming device may also include an input area 530 where buttons, meters, bill acceptors, ticket printers, and other input or output devices for interacting with the gaming device are located.

The second gaming display 555 may include a video display, such as an LCD, LED, CRT, or other screen, that is configured to show a variety of images, artwork, attract screens, messaging, and secondary games. As shown in FIG. 5C, the second gaming display 555 can be configured to show a video slot game including a second game grid 560 showing portions of virtual game reels 565 each having a plurality of game symbols 570. The video display 555 may also have an interface area 580 that shows messaging, meters, etc., as well as "soft" input devices such as a touch screen buttons, etc.

Figure 5A:
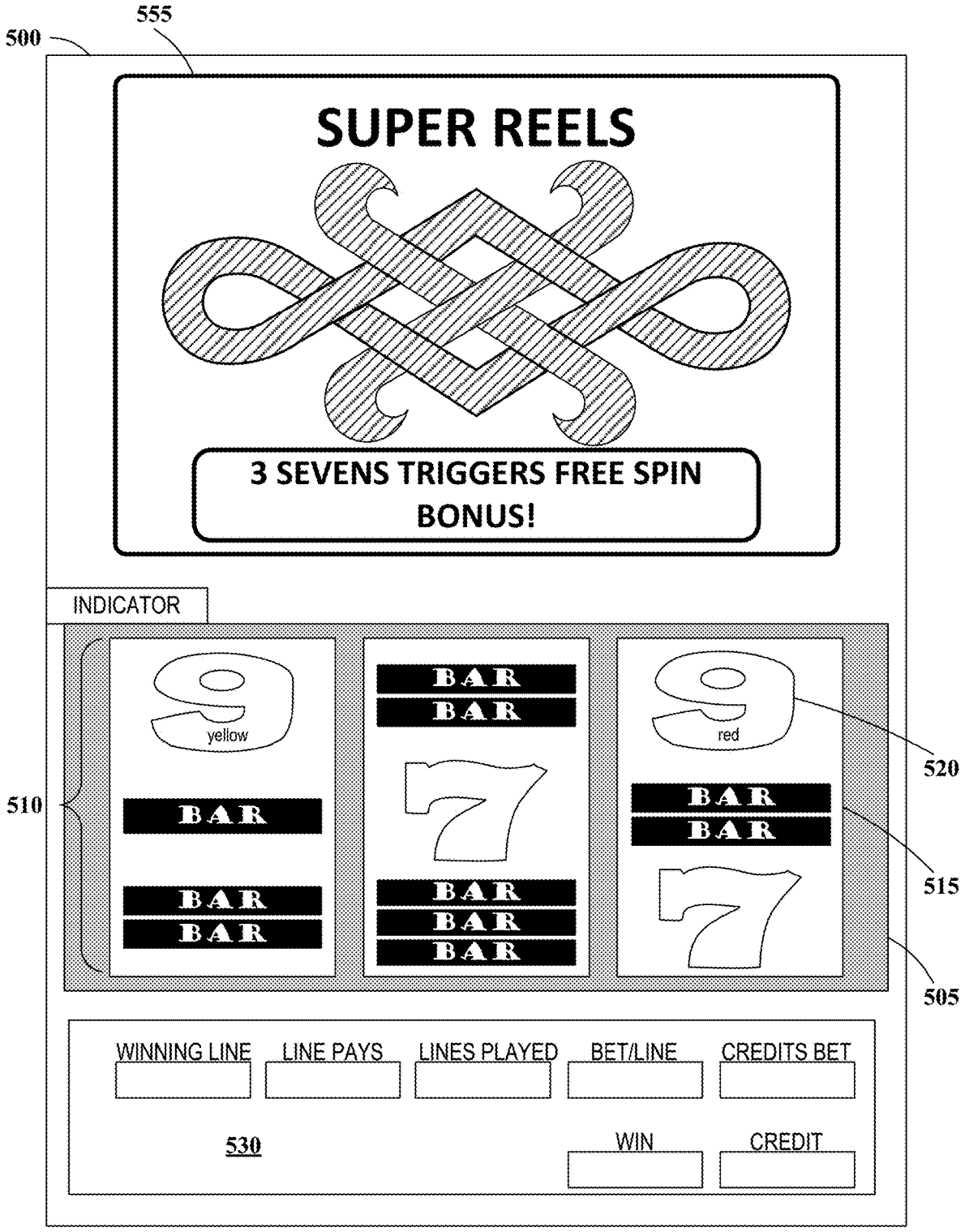
FIGS. 5A, 5B, 5C and 5D are detail diagrams of a gaming device having a first gaming display and a second gaming display showing an example game progression according to embodiments of the invention.
Figure 5B:
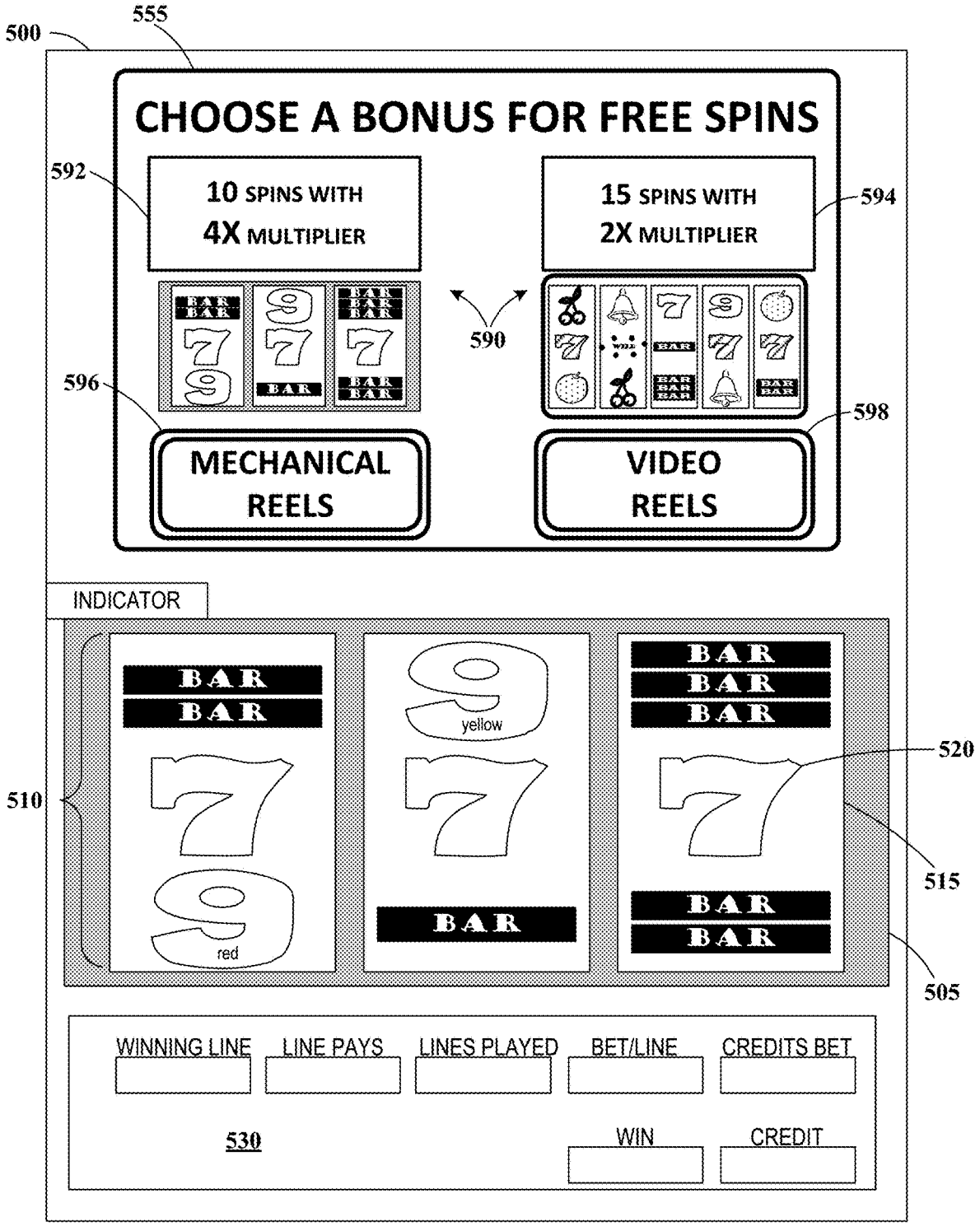
Figure 5C:
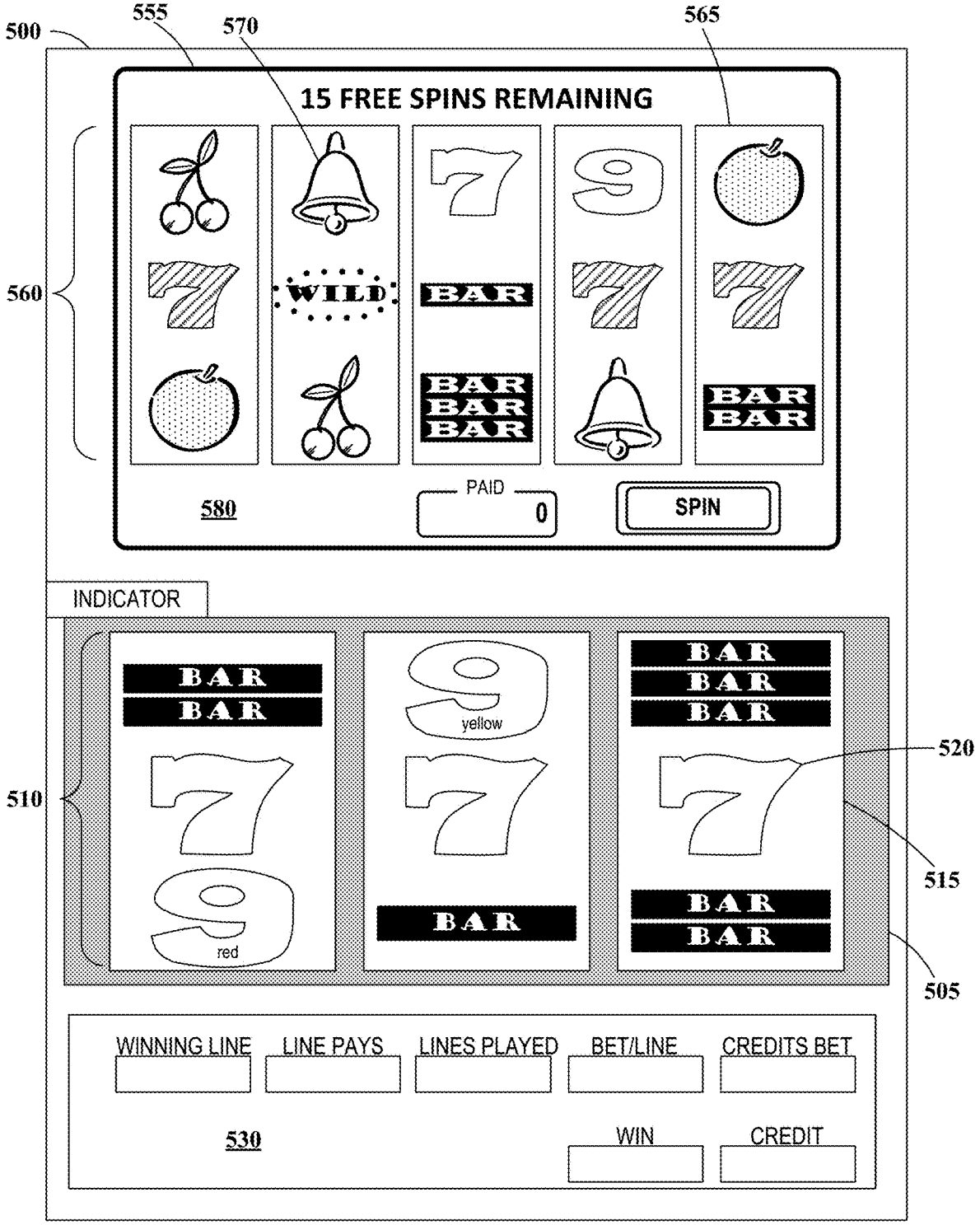
Figure 5D:
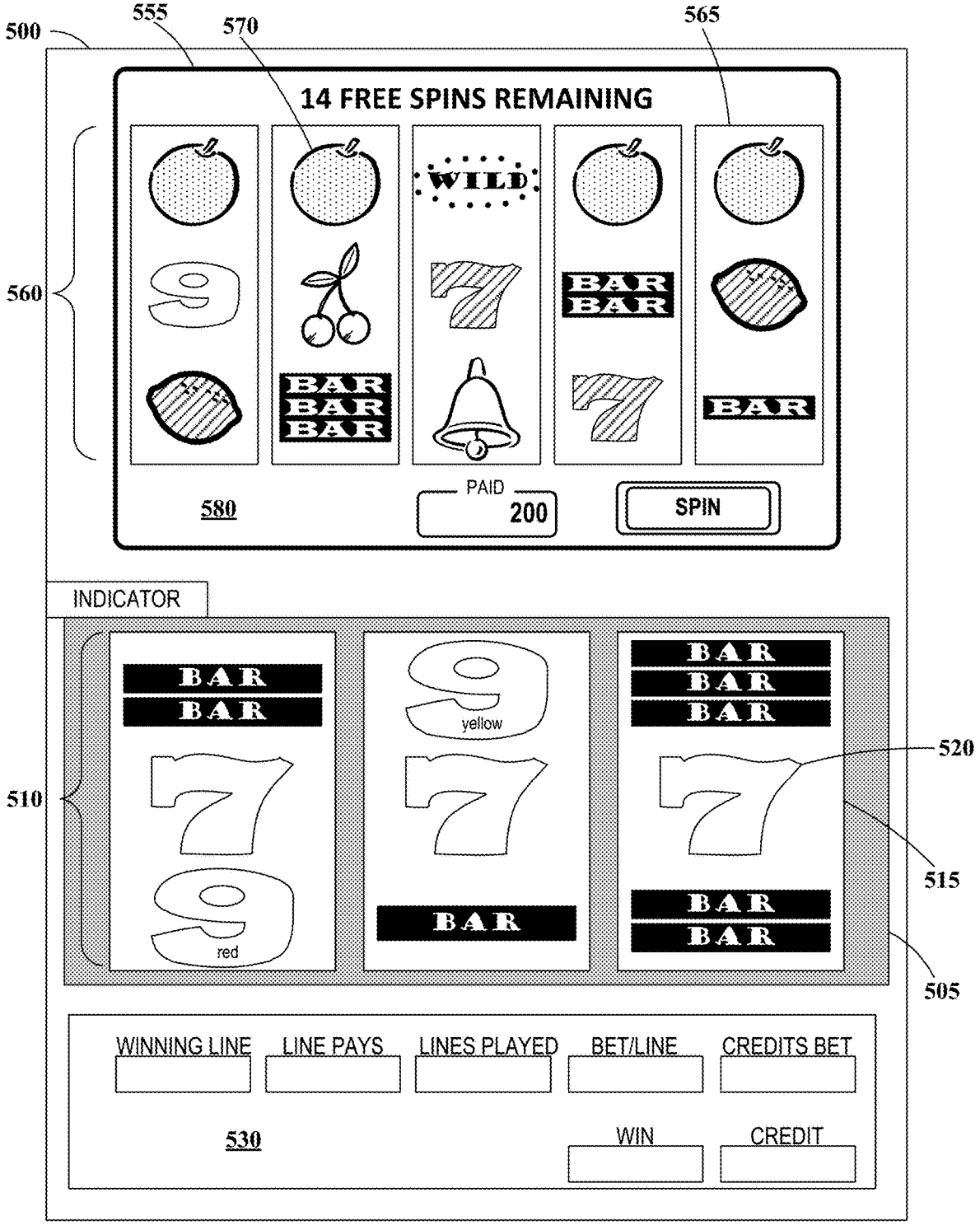

In FIG. 5A, a primary game is played on the first game display 505, but does not result in a bonus being triggered. As shown in the messaging box in the second game display, a player needs three "7" symbols on a payline to trigger a bonus feature. In FIG. 5B, a second gaming event is completed on the first game display 505. This time, a bonus triggering condition of three "7" symbols on a payline is satisfied, thereby triggering the bonus feature. Here, a selection screen is presented to the player on the second game display 555. The selection screen may include a description of the available bonus choices, along with notable characteristics 592, 594 of each of the bonus options. Selection buttons 596, 598 may also be presented on the second game display to facilitate selection of the desired bonus. In some embodiments, the input area 530 may also be used to selected one of the bonus options. In various embodiments, the selection process may be associated with a timer, where a default one of the bonuses is automatically selected if a player selection is not received in predetermined amount of time. As shown in FIG. 5C, the player has selected the video bonus, and the second game display 555 is updated to show the video slot bonus game. In FIG. 5D, a result from a first one of the 15 free spins is shown on the second game grid 560 of the second game display 555.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above and in the appended claims.

The invention claimed is:

1. A gaming device comprising:

a game cabinet;

a first game display housed in the game cabinet, the first game display including a plurality of mechanical spinning reels each having a plurality of first game symbols, and including a first game grid covering the plurality of mechanical spinning reels while allowing portions of the mechanical reels to be visible outside of the game cabinet;

a second game display housed in the game cabinet, where the first game display and the second game display are separately housed in the game cabinet to be simultaneously and independently visible, the second game display including a video display device configured to display a second game grid showing portions of a plurality of virtual game reels in a matrix of symbol positions;

a memory device configured to store a credit amount;

a wager input device structured to receive physical items associated with currency values; and a processor operable to:

receive a signal from the wager input device indicating receipt of a physical item associated with a currency value;

increase the credit amount stored in the memory based on the currency value of the received physical item;

receive a wager on a primary game event, where an amount of the wager is deducted from the credit amount stored in the memory;

display a first game outcome of the primary game event on the first game display;

determine whether a bonus condition is satisfied during the primary game event;

display a bonus selection screen when the bonus condition is satisfied during the primary game event;

initiate a first bonus event on the first game display when a signal is received indicating selection of the first bonus event from the bonus selection screen, the first bonus event including presenting a plurality of free games using the mechanical spinning reels and first game grid;

initiate a second bonus event on the second game display when a signal is received indicating selection of the second bonus event from the bonus selection screen, the second bonus event including presenting a plurality of free games using the virtual game reels and second game grid, where the second bonus event has at least one game characteristic different from the first bonus event; and increase the credit amount stored in memory by amounts of any awards determined from the primary game event and the selected bonus event.

2. The gaming device of claim 1, wherein the second bonus event includes a different number of free spins from the first bonus event.

3. The gaming device of claim 1, wherein the bonus selection screen includes information regarding the at least one different characteristic between the first bonus event and the second bonus event.

4. The gaming device of claim 1, wherein the first bonus event includes a first multiplier used to multiply any awards received in the first bonus event.

5. The gaming device of claim 1, wherein the second bonus event includes a second multiplier used to multiply any awards received in the second bonus event.

6. The gaming device of claim 1, wherein the plurality of mechanical spinning reels in the first game display has a different number of reels than the plurality of virtual game reels in the second game display.

7. The gaming device of claim 1, wherein the first game grid covering the plurality of mechanical spinning reels in the first game display includes a transmissive video screen display.

8. The gaming device of claim 7, wherein the transmissive video screen display is configured to show transmissive symbols overlaying the mechanical spinning reels.

9. The gaming device of claim 1, wherein the first game grid covering the plurality of mechanical spinning reels in the first game display includes a glass surface with one or more translucent windows to show portions of the mechanical spinning reels, and includes an opaque portion.

10. The gaming device of claim 1, wherein the processor is further configured to receive a signal to display the primary gaming event on the second game display.

11. A gaming device comprising:

a game cabinet;

a first game display housed in the game cabinet, the first game display including a video display device configured to display a first game grid of card positions for displaying a video poker hand;

a second game display housed in the game cabinet, where the first game display and the second game display are separately housed in the game cabinet to be simultaneously and independently visible, the second game display including a plurality of mechanical spinning reels each having a plurality of game symbols, and including a second game grid covering the plurality of mechanical spinning reels while allowing portions of the mechanical reels to be visible outside of the game cabinet;

a memory device configured to store a credit amount;

a wager input device structured to receive physical items associated with currency values; and a processor operable to:

receive a signal from the wager input device indicating receipt of a physical item associated with a currency value;

increase the credit amount stored in the memory based on the currency value of the received physical item;

receive a wager on a first primary video poker game event, where an amount of the wager is deducted from the credit amount stored in the memory;

display a first game outcome of the first primary video poker game event on the first game display;

determine whether a bonus condition is satisfied during the first primary video poker game event;

display a bonus selection screen when the bonus condition is satisfied during the first primary video poker game event;

initiate a first bonus event on the first game display when a signal is received indicating selection of the first bonus event from the bonus selection screen, the first bonus event including randomly selecting a first multiplier to apply to a second primary video poker game event;

initiate a second bonus event on the second game display when a signal is received indicating selection of the second bonus event from the bonus selection screen, the second bonus event including presenting a plurality of free games using the mechanical spinning reels and the second game grid; and increase the credit amount stored in memory by amounts of any awards determined from the first primary video poker game event and the selected bonus event.

12. The gaming device of claim 11, wherein the second bonus event includes a second multiplier used to multiply any awards received in the second bonus event.

13. The gaming device of claim 11, wherein the second game grid covering the plurality of mechanical spinning reels in the second game display includes a transmissive video screen display.

14. The gaming device of claim 13, wherein the transmissive video screen display is configured to show transmissive symbols overlaying the mechanical spinning reels.

15. The gaming device of claim 11, wherein the second game grid covering the plurality of mechanical spinning reels in the second game display includes a glass surface with one or more translucent windows to show portions of the mechanical spinning reels, and includes an opaque portion.

16. A gaming device comprising:

a game cabinet;

a first game display housed in the game cabinet, the first game display including a video display device configured to display a first game grid of card positions for displaying a video poker hand;

a second game display housed in the game cabinet, where the first game display and the second game display are separately housed in the game cabinet to be simultaneously and independently visible, the second game display including a video display device configured to display a second game grid showing portions of a plurality of virtual game reels in a matrix of symbol positions;

a memory device configured to store a credit amount;

a wager input device structured to receive physical items associated with currency values; and a processor operable to:

receive a signal from the wager input device indicating receipt of a physical item associated with a currency value;

increase the credit amount stored in the memory based on the currency value of the received physical item;

receive a wager on a first primary video poker game event, where an amount of the wager is deducted from the credit amount stored in the memory;

display a first game outcome of the first primary video poker game event on the first game display;

determine whether a bonus condition is satisfied during the first primary video poker game event;

display a bonus selection screen when the bonus condition is satisfied during the first primary video poker game event;

initiate a first bonus event on the first game display when a signal is received indicating selection of the first bonus event from the bonus selection screen, the first bonus event including randomly selecting a first multiplier to apply to a second primary video poker game event;

initiate a second bonus event on the second game display when a signal is received indicating selection of the second bonus event from the bonus selection screen, the second bonus event including presenting a plurality of free games using the virtual game reels and second game grid; and increase the credit amount stored in memory by amounts of any awards determined from the first primary video poker game event and the selected bonus event.

17. The gaming device of claim 16, wherein the second bonus event includes a second multiplier used to multiply any awards received in the second bonus event.

18. The gaming device of claim 16, wherein the bonus condition is satisfied when a sub-symbol is received in the first game outcome.

19. The gaming device of claim 16, wherein the bonus condition is satisfied when a pre-defined poker combination is received in the first game outcome.

20. The gaming device of claim 16, wherein the bonus condition is satisfied based on a random determination made during the first primary video poker game event.

* * * * *